US010041223B2

(12) United States Patent
Chen et al.

(10) Patent No.: US 10,041,223 B2
(45) Date of Patent: Aug. 7, 2018

(54) METHOD FOR TACKLING REPELLING OF HAMMERING DURING PIPE PILE DRIVING

(71) Applicant: PoweChina Huadong Engineering Coporation Limited, Zhejiang (CN)

(72) Inventors: Wenhua Chen, Hangzhou (CN); Haifeng Qi, Hangzhou (CN); Jing Hou, Hangzhou (CN); Zhenqiang Jiang, Hangzhou (CN); Caiyun Huan, Hangzhou (CN); Bo Jin, Hangzhou (CN)

( * ) Notice: Subject to any disclaimer, the term of this patent is extended or adjusted under 35 U.S.C. 154(b) by 0 days.

(21) Appl. No.: 15/479,920

(22) Filed: Apr. 5, 2017

(65) Prior Publication Data

US 2017/0362790 A1 Dec. 21, 2017

(30) Foreign Application Priority Data

Jun. 21, 2016 (CN) ..... 2016 1 0452723

(51) Int. Cl.

| | |
|---|---|
| ***E02D 7/24*** | (2006.01) |
| ***E02D 5/32*** | (2006.01) |
| *E02D 7/02* | (2006.01) |

(52) U.S. Cl.

CPC ..... *E02D 7/24* (2013.01); *E02D 5/32* (2013.01); *E02D 7/02* (2013.01)

(58) Field of Classification Search

CPC combination set(s) only.
See application file for complete search history.

(56) References Cited

U.S. PATENT DOCUMENTS 1,409,760 A * 3/1922 O'Marr ..... E02D 7/24 175/207
2007/0177948 A1* 8/2007 Fedrick ..... E02D 5/32 405/228

* cited by examiner

*Primary Examiner* — Sean D Andrish
(74) *Attorney, Agent, or Firm* — Wayne & Ken, LLC; Tony Hom

(57) ABSTRACT

The present invention provides a method for tackling the repelling of hammering during pipe pile driving. The technical scheme of the present invention includes: when repelling of hammering occurs in the process of piling through a sand layer, drill holes downwardly around and/or inside the pipe pile, and jet high-pressure water to the sand layer below to cut and disturb the sand layer.

7 Claims, 9 Drawing Sheets

METHOD FOR TACKLING REPELLING OF HAMMERING DURING PIPE PILE DRIVING

FIELD OF THE INVENTION

The present invention relates to a method for tacking repelling of hammering during pipe pile driving, which is applied to geotechnical engineering.

BACKGROUND OF THE INVENTION

Large diameter steel pipe piles and Prestress High Concrete (PHC) piles have been widely used in offshore wind energy, drilling platforms, ports or piers, thermal power plants, civil engineering and other projects. However, in the process of driving piles through a sand layer, large excess pore pressure accumulates due to the vibration of piling. The excess pore pressure in the sand layer dissipates fast, which results in the rapid increase of density and capacity of sandy soil. Consequently, the friction resistance and/or tip resistance of the pipe pile substantially increase, resulting in repelling of hammering.

SUMMARY OF THE INVENTION

According to the above problem, the present invention provides a method for tackling repelling of hammering during pipe pile driving, which is of simple structure and can be carried out easily. The technical scheme of the present invention comprises: when repelling of hammering occurs in the process of piling through a sand layer, drill holes downwardly around and/or inside the pipe pile, and jet high-pressure water into the sand layer below to cut and disturb the sand layer, which consequently decreases the soil resistance to the pipe pile and increases the driveability. Aiming to consider different situations, four detailed methods are adopted respectively as below.

When the sand layer exists around the pile shaft, drill holes around the pipe pile to 0.5-1.0 m above the sand layer, and start jetting high-pressure water. Keep drilling and jetting until the drill head reach 0.5-1 m below the bottom of the sand layer.

When the sand layer is beneath the pile tip, drill holes inside the pipe pile to 0.5-1.0 m above the sand layer, and start jetting high-pressure water. Keep drilling and jetting until the drill head reaches the depth of 3D (D is for the diameter of the pile) below the pile tip.

When the sand layers are both surrounding the pile shaft and beneath the pile tip, drill holes around the pipe pile to 0.5-1.0 m above the sand layer surrounding the pile shaft, and start jetting high-pressure water. Keep drilling and jetting until the drill head reaches 0.5-1 m below the bottom of the sand layer; drill holes inside the pipe pile to 0.5-1.0 m above the sand layer beneath the pile tip, and start jetting high-pressure water. Keep drilling and jetting until the drill head reaches the depth of 3D below the pile tip.

When the sand layers are both surrounding the pile shaft and beneath the pile tip, drill holes around the pipe pile to 0.5-1.0 m above the sand layer surrounding the pile shaft, and start jetting high-pressure water. Keep drilling and jetting until the drill head reaches the depth of 3D below the pile tip; then, remove the sand inside the pipe pile to the depth 3D below the pile tip.

The water pressure is controlled in a range of 1~25 MPa. The diameter of the drilling holes is 76~108 mm. Construction equipment for jet grouting are used for hole drilling and water jetting.

More than four and five drilling holes are placed around the pile shaft and inside the pile respectively, to fully disturb the sand layers around the pile shaft and beneath the pile tip.

The present invention benefits from disturbing the soil around the pile shaft and beneath the pile tip to decrease the pile friction and tip resistance, and consequently driving the pile to the preset level. The present invention can be further used to resolve the problems in sinking precast pile into dense sand layer. Benefiting from simple principle, available devices, and economical efficiency, the present invention can be effectively used to tackle repelling of hammering and obtain positive economic and social interest.

DETAILED DESCRIPTION OF ILLUSTRATED EMBODIMENTS

Figure 1:
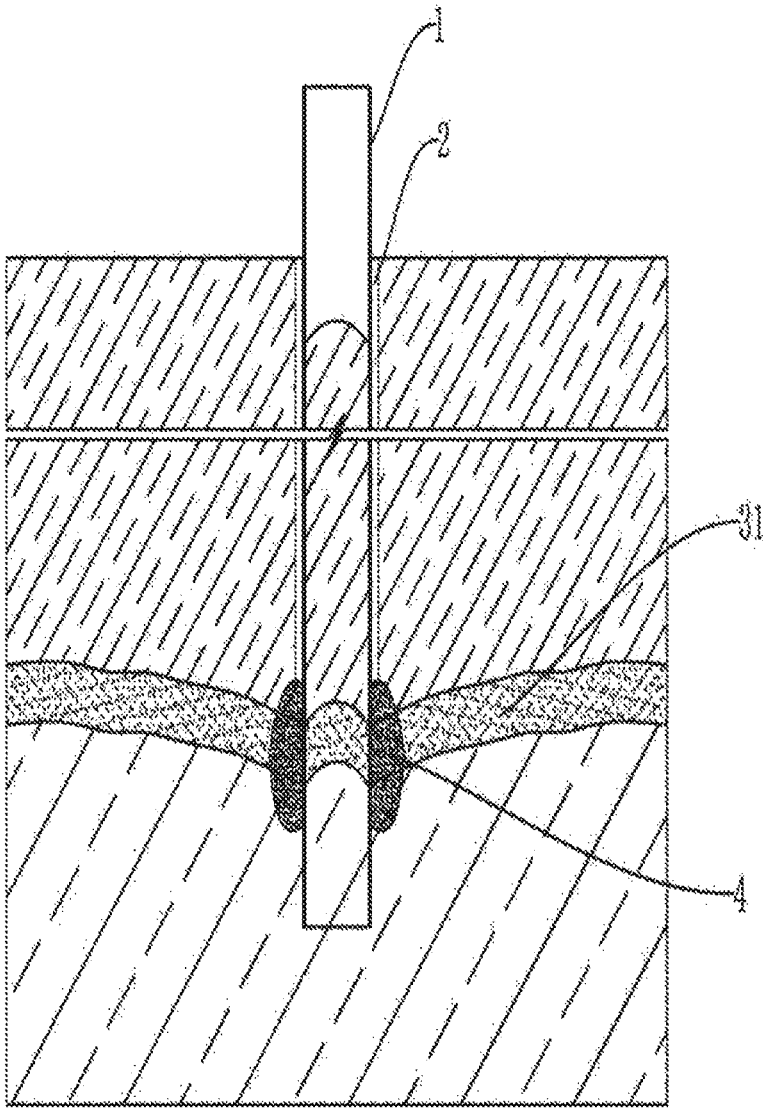
FIG. 1 is a schematic structural view in embodiment 1.
Figure 2:
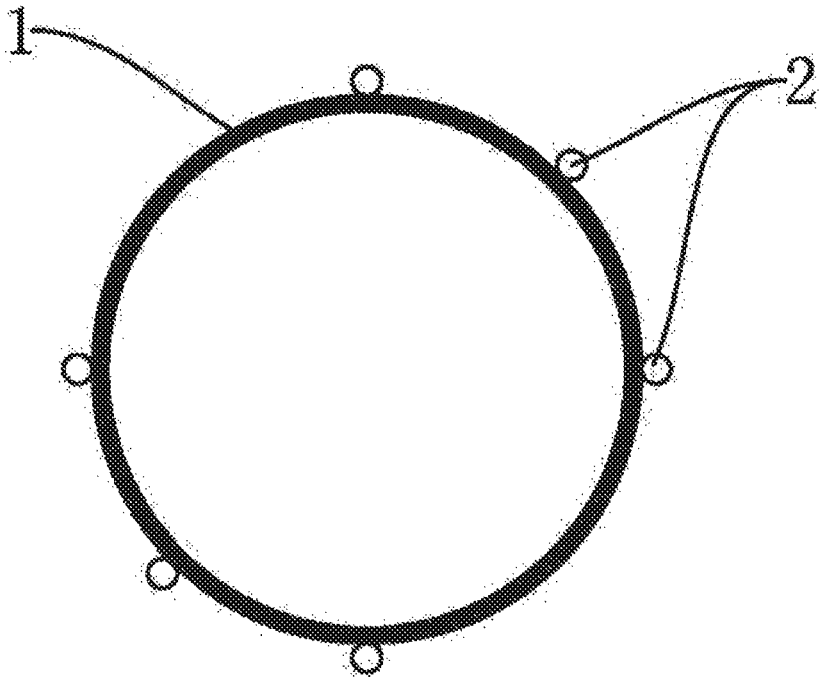
FIG. 2 is a schematic plan view of device layout in embodiment 1.

Embodiment 1: as shown in FIG. 1 and FIG. 2, if the repelling of hammering occurs when driving a pipe pile 1 into a sand layer 31, four or more drilling holes 2 are arranged around the pipe pile 1 shaft, depending on the diameter of the pipe pile 1. The diameter of the drilling holes 2 is in the range of 76~108 mm. Firstly, drilling holes around the pipe pile 1 to 0.5-1.0 m above the sand layer 31, and then start jetting high-pressure water. Keep drilling and jetting until the drill head reach 0.5-1 m below the bottom of the sand layer 31. Construction equipment for jet grouting are used for hole drilling and water jetting with the pressure of the water or gas-water mixture controlled in a range of 1~25 MPa. Through jetting the high-pressure water or gas-water mixture, the disturbed region 4 of the sand layer 31 is developed and consequently the friction resistance from the sand layer 31 is reduced. Thus the pipe pile 1 can be re-driven to the preset depth.

Figure 3:
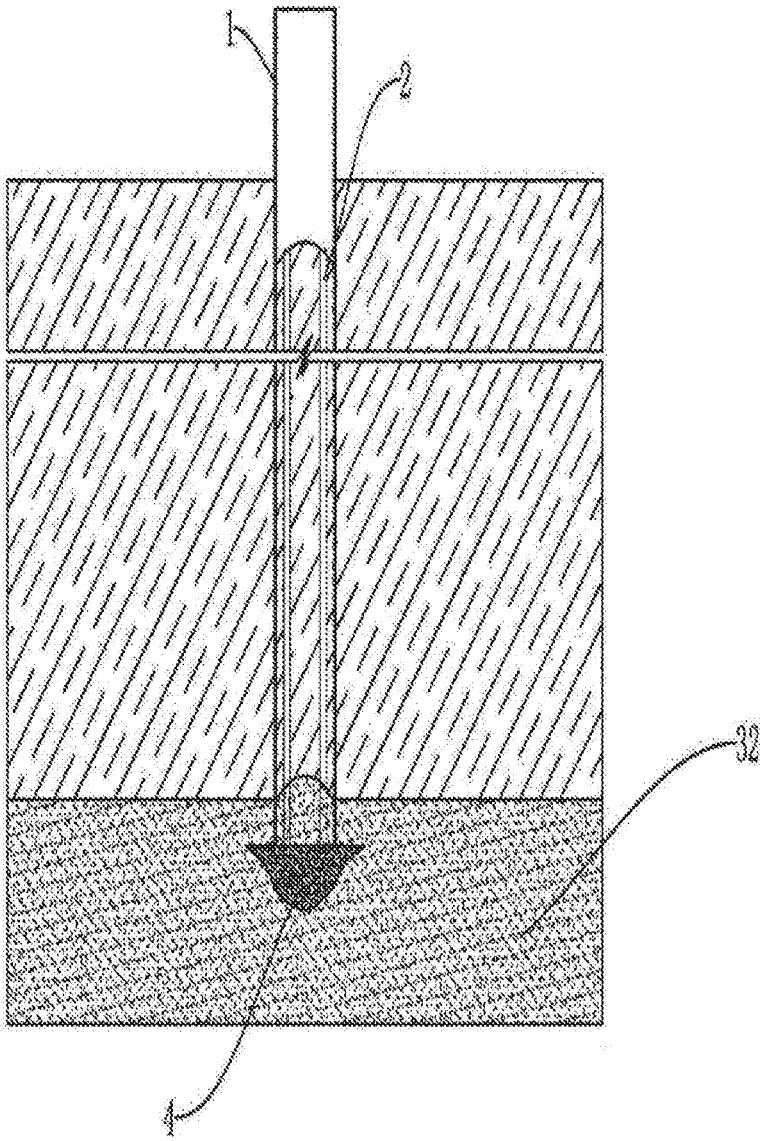
FIG. 3 is a schematic structural view in embodiment 2.
Figure 4:
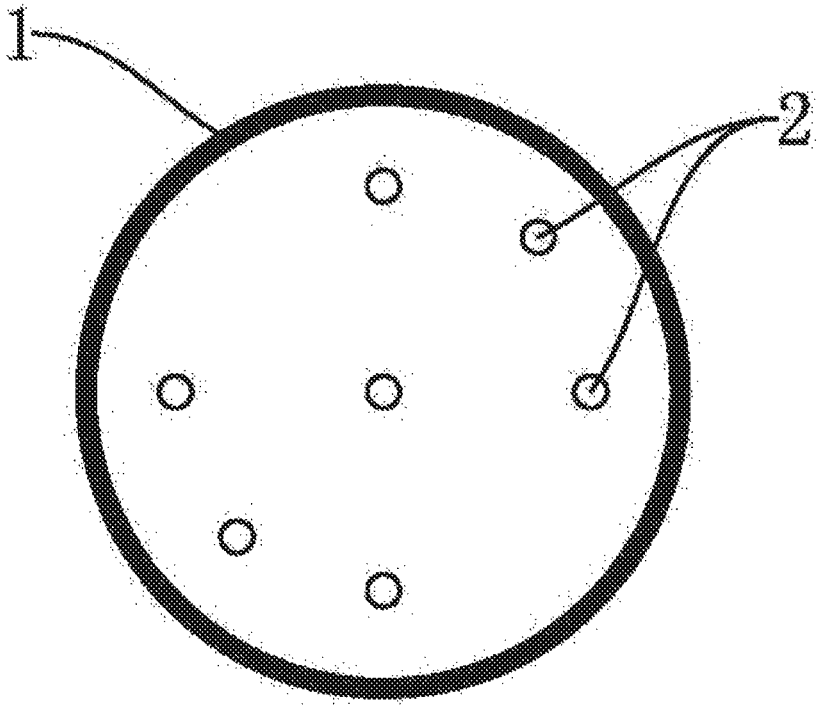
FIG. 4 is a schematic plan view of device layout in embodiment 2.

Embodiment 2: as shown in FIG. 3 and FIG. 4, if the repelling of hammering occurs when driving a pipe pile 1 to the sand layer 32 beneath the pile tip, five or more drilling holes 2 are arranged inside the pipe pile 1 shaft, depending on the diameter of the pipe pile 1. The diameter of the drilling holes 2 is in the range of 76~108 mm. Firstly, drilling holes inside the pipe pile 1 to 0.5-1.0 m above the sand layer 32, and then start jetting high-pressure water or gas-water mixture. Keep drilling and jetting until the drill head reach a depth of 3D below pile tip, and D is the diameter of the pipe pile. Construction equipments for jet grouting are used for hole drilling and water jetting, with the pressure of the water or gas-water mixture controlled in a range of 1~25 MPa. Through jetting the high-pressure water or gas-water mixture, the disturbed region 4 of the sand layer 32 is developed and consequently the tip resistance from the sand layer 32 is reduced. Thus the pipe pile 1 can be re-driven to the preset depth.

Figure 5:
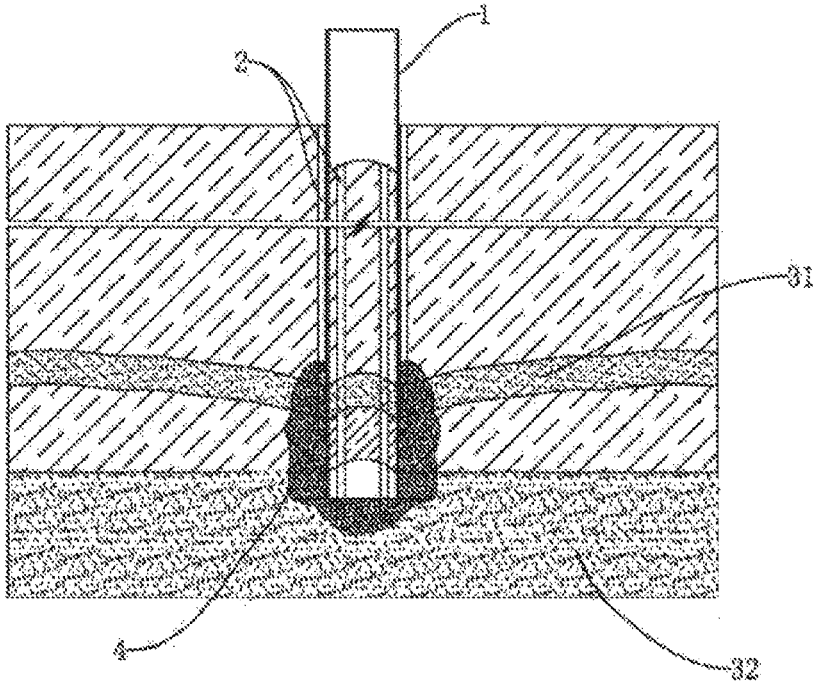
FIG. 5 is a schematic structural view in embodiment 3.
Figure 6:
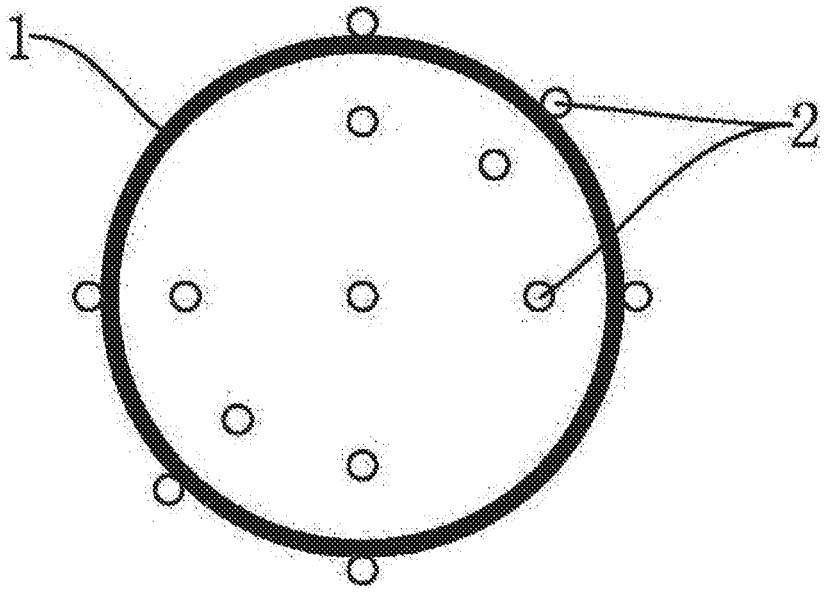
FIG. 6 is a schematic plan view of device layout in embodiment 3.

Embodiment 3: as shown in FIG. 5 and FIG. 6, if the repelling of hammering occurs when drive a pipe pile 1 to the sand layer 3, more than 4 drilling holes 2 are arranged around the outside and more than 5 drilling holes 2 are arranged inside the pipe pile 1 respectively, depending on the diameter of the pipe pile 1. The diameter of the drilling holes 2 is in the range of 76~108 mm. Firstly, drilling holes around the pipe pile 1 to 0.5-1.0 m above the sand layer 31, and then start jetting high-pressure water or gas-water mixture. Keep drilling and jetting until the drill head reaches the depth of 3D below the pile tip. Meanwhile, drill holes 2 inside the pipe pile 1 to 0.5-1.0 m above the sand layer 32, and start jetting high-pressure water or gas-water mixture. Keep drilling and jetting until the drill head reaches the depth of 3D below the pile tip. Construction equipments for jet grouting are used for hole drilling and water jetting, with the pressure of the water or gas-water mixture controlled in a range of 1~25 MPa. Through jetting the high-pressure water or gas-water mixture, the disturbed region 4 of the sand layer is developed and consequently both the friction and tip resistance from the sand layer are reduced. Thus the pipe pile 1 can be re-driven to the preset depth.

Figure 7:
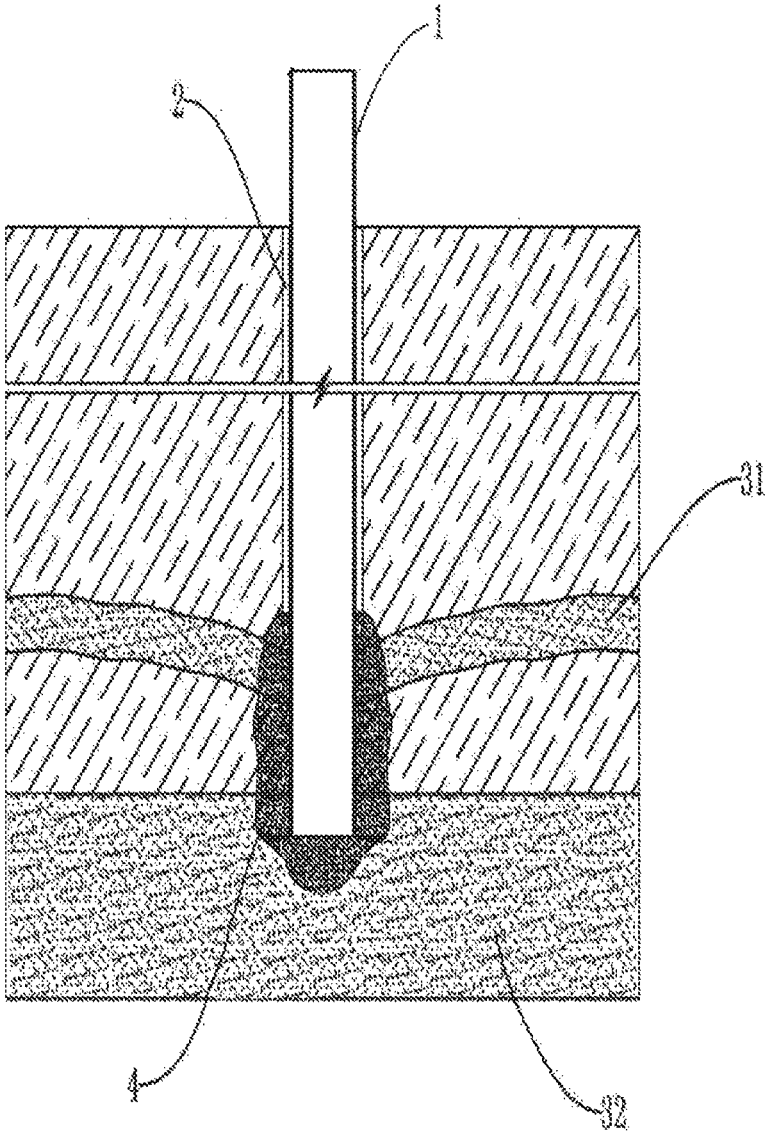
FIG. 7 is a schematic structural view in embodiment 4.
Figure 8:
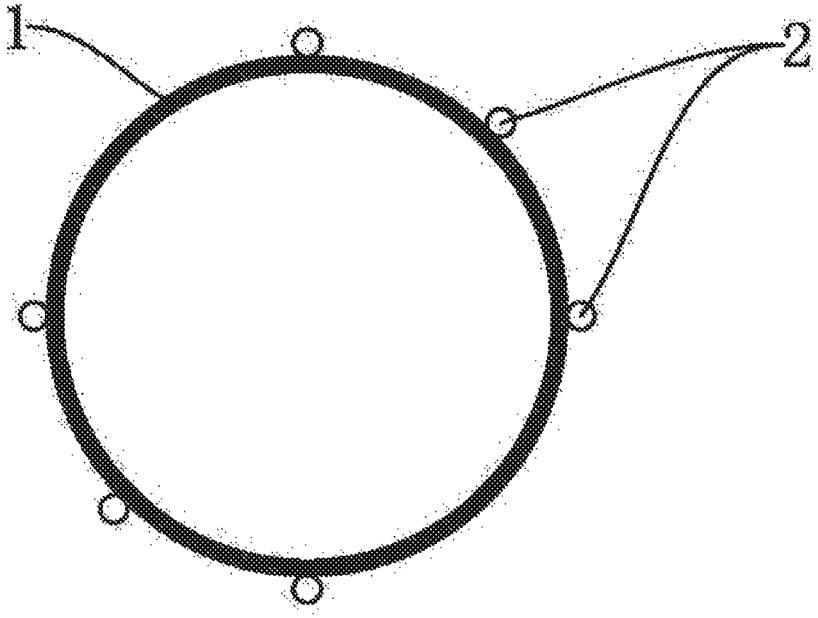
FIG. 8 is a schematic plan view of device layout in embodiment 4.

Embodiment 4: as shown in FIG. 7 and FIG. 8, if the repelling of hammering occurs when driving a pipe pile 1 to the sand layer 32, 4 or more holes 2 are placed around the pipe pile 1, depending on the diameter of the pipe pile 1. The diameter of the drilling holes 2 is in the range of 76~108 mm. Firstly, drilling holes around the pipe pile 1 to 0.5-1.0 m above the sand layer 31, and then start jetting high-pressure water or gas-water mixture. Keep drilling and jetting until the drill head reaches the depth of 3D below the pile tip. Meanwhile remove all the soil inside the pipe pile. Construction equipments for jet grouting are used for hole drilling and water jetting, with the pressure of the water or gas-water mixture is controlled in a range of 1~25 MPa. Through jetting the high-pressure water or gas-water mixture, the disturbed region 4 of the sand layer is developed and consequently both the friction resistance from the sand layer 3 is reduced. Furthermore removing all the soil inside the pipe pile contributes to the elimination of the friction resistance inside the pipe pile and the decreasing of the tip resistance from the sand layer 32 beneath the pile tip. Thus the pipe pile 1 can be re-driven to the preset depth.

Figure 9:
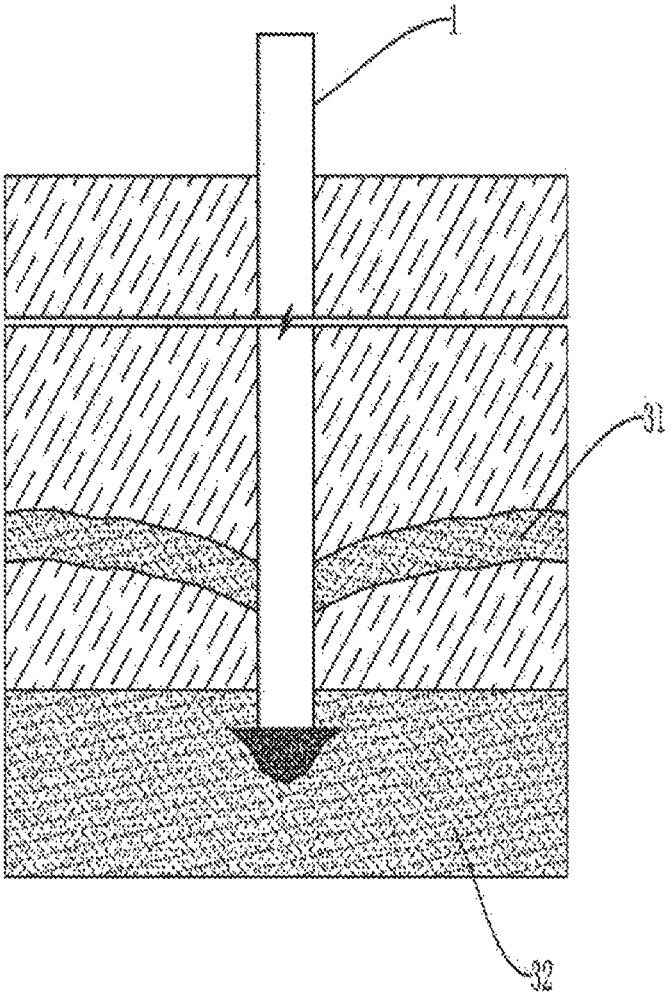
FIG. 9 is a schematic structural view in embodiment 5.

Embodiment 5: as shown in FIG. 9, if the repelling of hammering occurs when driving a pipe pile 1 to the sand layer 32, remove the soil both inside the pipe pile 1 and in the region from the pile tip to the depth of 3D below the pile tip to eliminate the friction resistance inside the pipe pile 1 and decrease the tip resistance from the sand layer 32. Thus the pipe pile 1 can be re-driven to the preset depth.

We claim:

1. A method for tackling repelling of hammering during pipe pile driving, comprising:

drilling holes downwardly around or inside the pipe pile (1) until a drill head reaches a sand layer (3);

jetting high-pressure water from a plurality of drill holes (2) to cut and disturb the sand layer (3) to decrease the soil resistance to the pipe pile (1); and cease the drilling and jetting when the drill head reaches a depth of 0.5-1.0 m below the sand layer (31);

wherein the high-pressure water is jetted when the plurality of drill holes arranged around the pipe pile (1) shaft reaches a depth of 0.5-1.0 m above the sand layer (31).

2. The method of claim 1, wherein the drilling and jetting cease until the drill head reaches a depth of 3D below a tip of the pipe pile; the D is the diameter of the pipe pile (1).

3. The method of claim 1, wherein the high-pressure water is jetted when the plurality of drill holes arranged around the pipe pile (1) reaches 0.5-1.0 m above the sand layer (31); keep drilling and jetting until the drill head reaches a depth of 3D below a tip of the pipe pile (1); drilling holes inside the pipe pile (1) to 0.5-1.0 m above the sand layer (32), and start jetting high-pressure water; keep drilling and jetting until the drill head reaches the depth of 3D below the pipe pile (1) tip; the D is the diameter of the pipe pile (1).

4. The method of claim 1, wherein when the plurality of drill holes arranged around or inside the pipe pile (1) reaches 0.5-1.0 m above the sand layer (31), start jetting high-pressure water; keep drilling and jetting until the drill head reaches a depth of 3D below a tip of the pipe pile (1), removing both soil inside the pipe pile (1) and soil in the region from the pipe pile (1) tip to the depth of 3D below the pipe pile (1) tip; the D is the diameter of the pipe pile (1).

5. The method of claim 1, wherein a water pressure from the plurality of drill holes (2) is controlled in a range of 1~25 MPa.

6. The method of claim 1, wherein a diameter of the plurality of drill holes (2) is 76~108 mm.

7. The method of claim 1, wherein more than four drill holes (2) are arranged around the pipe pile (1) shaft to fully disturb the sand layer (31); and more than five drill holes (2) are arranged inside the pipe pile (1) to fully disturb the sand layer (32).

* * * * *